US010544933B2

(12) United States Patent
Hand et al.

(10) Patent No.: US 10,544,933 B2
(45) Date of Patent: Jan. 28, 2020

(54) LIGHT FIXTURE WITH ROTATABLE SPEAKERS

(71) Applicant: ABL IP Holding LLC, Atlanta, GA (US)

(72) Inventors: Mitchell C. Hand, McDonough, GA (US); David P. Zizzi, Atlanta, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 15/945,087

(22) Filed: Apr. 4, 2018

(65) Prior Publication Data

US 2019/0309939 A1 Oct. 10, 2019

(51) Int. Cl.

| | |
|---|---|
| ***F21V 33/00*** | (2006.01) |
| ***F21V 14/02*** | (2006.01) |
| ***H04R 1/02*** | (2006.01) |

(52) U.S. Cl.

CPC ..... *F21V 33/0056* (2013.01); *F21V 14/02* (2013.01); *H04R 1/028* (2013.01); *F21V 33/0076* (2013.01)

(58) Field of Classification Search

CPC .... F21V 33/056; F21V 33/0076; F21V 14/02; H04R 1/028

See application file for complete search history.

(56) References Cited

U.S. PATENT DOCUMENTS 5,058,169 A 10/1991 Temmer
5,868,489 A 2/1999 Fuller et al.
5,980,057 A 11/1999 Christie
6,343,135 B1 1/2002 Ellero et al.
6,443,592 B1 9/2002 Unger et al.
7,351,075 B1 4/2008 Patterson et al.
7,455,435 B2 11/2008 Mathews et al.
7,467,881 B2 12/2008 McMillen
7,604,378 B2 10/2009 Wolf et al.
7,766,518 B2 8/2010 Piepgras et al.
(Continued)

OTHER PUBLICATIONS

"IAV LightSpeaker review: Best light best speaker", Available online at: http://www.techhive.com/article/2984809/lighting/lightspeaker-review-best-light-best-speaker-but-its-not-the-best-lightspeaker.html, Sep. 21, 2015, 4 pages.
(Continued)

*Primary Examiner* — Mary Ellen Bowman
(74) *Attorney, Agent, or Firm* — Kilpatrick Townsend & Stockton LLP

(57) ABSTRACT

A light fixture includes a light fixture housing, one or more light sources housed in the housing, a power connection for receiving electric power for the one or more light sources, a light source driver circuit configured to receive power from the power connection and to drive the one or more light sources to produce light, and at least one audio speaker module coupled to the housing through at least one rotatable coupling. The light fixture further includes a wireless radio transceiver configured to receive transmissions of audio content to be played through the at least one audio speaker module, and an audio driver circuit configured to receive power from the power connection and to drive the at least one audio speaker module. The at least one audio speaker module is rotatable with respect to the housing via the at least one rotatable coupling.

19 Claims, 12 Drawing Sheets

(56) References Cited

U.S. PATENT DOCUMENTS

| | | | | |
|---|---|---|---|---|
| 7,784,957 | B2 | 8/2010 | Wright | |
| 7,844,060 | B2 | 11/2010 | Zulkowski | |
| 7,938,562 | B2 * | 5/2011 | Ivey | F21V 33/0052 362/276 |
| 8,042,961 | B2 | 10/2011 | Massara et al. | |
| 8,096,678 | B2 | 1/2012 | Jones, III et al. | |
| 8,172,435 | B2 | 5/2012 | Spiro et al. | |
| 8,229,155 | B2 | 7/2012 | Maurer et al. | |
| 8,251,544 | B2 | 8/2012 | Ivey et al. | |
| 8,259,980 | B2 | 9/2012 | Maurer et al. | |
| 8,282,227 | B2 | 10/2012 | Massara et al. | |
| 8,299,903 | B2 | 10/2012 | Haase et al. | |
| 8,300,869 | B2 | 10/2012 | Marlin et al. | |
| 8,351,639 | B2 | 1/2013 | Chang | |
| 8,351,640 | B2 | 1/2013 | Chang | |
| 8,562,158 | B2 | 10/2013 | Chien | |
| 8,628,216 | B2 | 1/2014 | Ivey et al. | |
| 8,641,241 | B2 | 2/2014 | Farmer | |
| 8,666,104 | B2 | 3/2014 | Ivey et al. | |
| 8,711,216 | B2 | 4/2014 | Chien | |
| 8,760,514 | B2 | 6/2014 | Chien | |
| 8,847,491 | B2 | 9/2014 | Yotsumoto et al. | |
| 8,998,441 | B2 | 4/2015 | Kim | |
| 9,081,269 | B2 | 7/2015 | Conti | |
| 9,115,886 | B2 | 8/2015 | Lam et al. | |
| 9,143,741 | B1 | 9/2015 | Fu et al. | |
| 9,163,816 | B2 | 10/2015 | Baschnagel | |
| 9,172,917 | B1 | 10/2015 | Fu et al. | |
| 9,197,865 | B2 | 11/2015 | Chien | |
| 9,228,708 | B2 | 1/2016 | Dings et al. | |
| 9,236,767 | B2 | 1/2016 | Recker et al. | |
| 9,267,675 | B2 | 2/2016 | Wu | |
| 9,294,828 | B2 | 3/2016 | Rutherford | |
| 9,328,882 | B2 | 5/2016 | Spiro et al. | |
| 9,351,353 | B2 | 5/2016 | Recker et al. | |
| 9,353,939 | B2 | 5/2016 | Simon et al. | |
| 9,398,357 | B2 | 7/2016 | Berkman et al. | |
| 9,407,074 | B2 | 8/2016 | Cowles et al. | |
| 9,414,142 | B1 | 8/2016 | Zauhar et al. | |
| 9,441,634 | B2 | 9/2016 | Spiro | |
| 9,549,110 | B2 | 1/2017 | Chien | |
| 9,560,322 | B2 | 1/2017 | Chien | |
| 9,574,763 | B2 | 2/2017 | Chen | |
| 9,651,243 | B1 | 5/2017 | Springer | |
| 9,654,678 | B1 | 5/2017 | Fu et al. | |
| 9,668,053 | B1 | 5/2017 | Rivera et al. | |
| 9,739,472 | B1 | 8/2017 | Li | |
| 9,746,138 | B1 | 8/2017 | Thomas | |
| 9,750,118 | B2 | 8/2017 | Yotsumoto et al. | |
| 9,784,417 | B1 | 10/2017 | Springer | |
| 9,794,690 | B2 | 10/2017 | Wang et al. | |
| 9,820,024 | B1 | 11/2017 | Rolf | |
| 9,826,298 | B2 | 11/2017 | Sun et al. | |
| 9,838,652 | B2 | 12/2017 | Chien | |
| 9,848,265 | B2 | 12/2017 | Wen et al. | |
| 9,851,092 | B2 | 12/2017 | Yotsumoto et al. | |
| 2008/0130938 | A1 | 6/2008 | Wan | |
| 2010/0296685 | A1 | 11/2010 | Carle, Jr. et al. | |
| 2011/0176297 | A1 * | 7/2011 | Hsia | F21V 25/04 362/217.1 |
| 2014/0049939 | A1 | 2/2014 | Kuenzler et al. | |
| 2015/0330587 | A1 | 11/2015 | Lax et al. | |
| 2016/0134846 | A1 | 5/2016 | Miller et al. | |
| 2016/0154171 | A1 | 6/2016 | Kato et al. | |
| 2016/0215933 | A1 | 7/2016 | Skelton et al. | |
| 2016/0234414 | A1 | 8/2016 | Chen | |
| 2016/0241823 | A1 | 8/2016 | Blaser et al. | |
| 2016/0334082 | A1 | 11/2016 | Chen | |
| 2017/0045208 | A1 | 2/2017 | Lentine | |
| 2017/0054315 | A1 | 2/2017 | Chien | |
| 2017/0187154 | A1 | 6/2017 | Skelton et al. | |
| 2017/0198867 | A1 * | 7/2017 | Bilan | F21V 23/06 |
| 2017/0311062 | A1 | 10/2017 | Garrett et al. | |
| 2017/0366886 | A1 | 12/2017 | Bernier | |

OTHER PUBLICATIONS

"Klipsch LightSpeaker System 5.2.2 Wireless Sound and Efficient LED Lighting", Available online at: http://www.klipsch.com/products/lightspeaker-in-ceiling-lighting-and-audio-system, 2018, 3 pages.

"Eaton", Model# 4SHP3240BTS, Available Online at: http://www.cooperindustries.com/content/public/en/lighting/products/shoplights/_919894.html, Oct. 2017, 2 pages.

"Energetic Lighting", Model# 57001, Available Online at: https://www.energeticlighting.com/Series/Index/55, Dec. 2017, 1 page.

"Model# OYET2023", Available Online at: https://shop-oye.com/special-led-lights/11978-bluetooth-led-ceiling-light-play-music-bluetooth-connection-mobile-application-36w-3000-lumens-millions-of-colors-oye-team-oye-team.html, Dec. 2017, 2 pages.

"The Home Depot", Model# 54264141, Available Online at: https://www.homedepot.com/p/Commercial-Electric-50-Watt-3500-Lumens-4000K-Bright-White-40-in-White-Integrated-LED-Shoplight-with-Bluetooth-Speakers-54569141/207077391?, Oct. 2016, 6 pages.

* cited by examiner

LIGHT FIXTURE WITH ROTATABLE SPEAKERS

BACKGROUND OF THE INVENTION

Many different kinds of light fixtures are available. Light fixtures may be tailored to different kinds of spaces to be lit, may be presented in different styles, and may use different lighting technologies. Additional light fixture features and improvements are desirable.

BRIEF SUMMARY OF THE INVENTION

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

According to one aspect, a light fixture comprises a light fixture housing, one or more light sources housed in the light fixture housing, a power connection for receiving electric power for the one or more light sources, a light source driver circuit configured to receive power from the power connection and to drive the one or more light sources to produce light, and at least one audio speaker module coupled to the light fixture housing through at least one rotatable coupling. The at least one audio speaker module comprises a speaker housing. The light fixture further comprises a wireless radio transceiver configured to receive transmissions of audio content to be played through the at least one audio speaker module, and an audio driver circuit configured to receive power from the power connection and to drive the at least one audio speaker module to produce audio output of the audio content. The at least one audio speaker module is rotatable with respect to the light fixture housing via the at least one rotatable coupling.

DETAILED DESCRIPTION OF THE INVENTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 1:
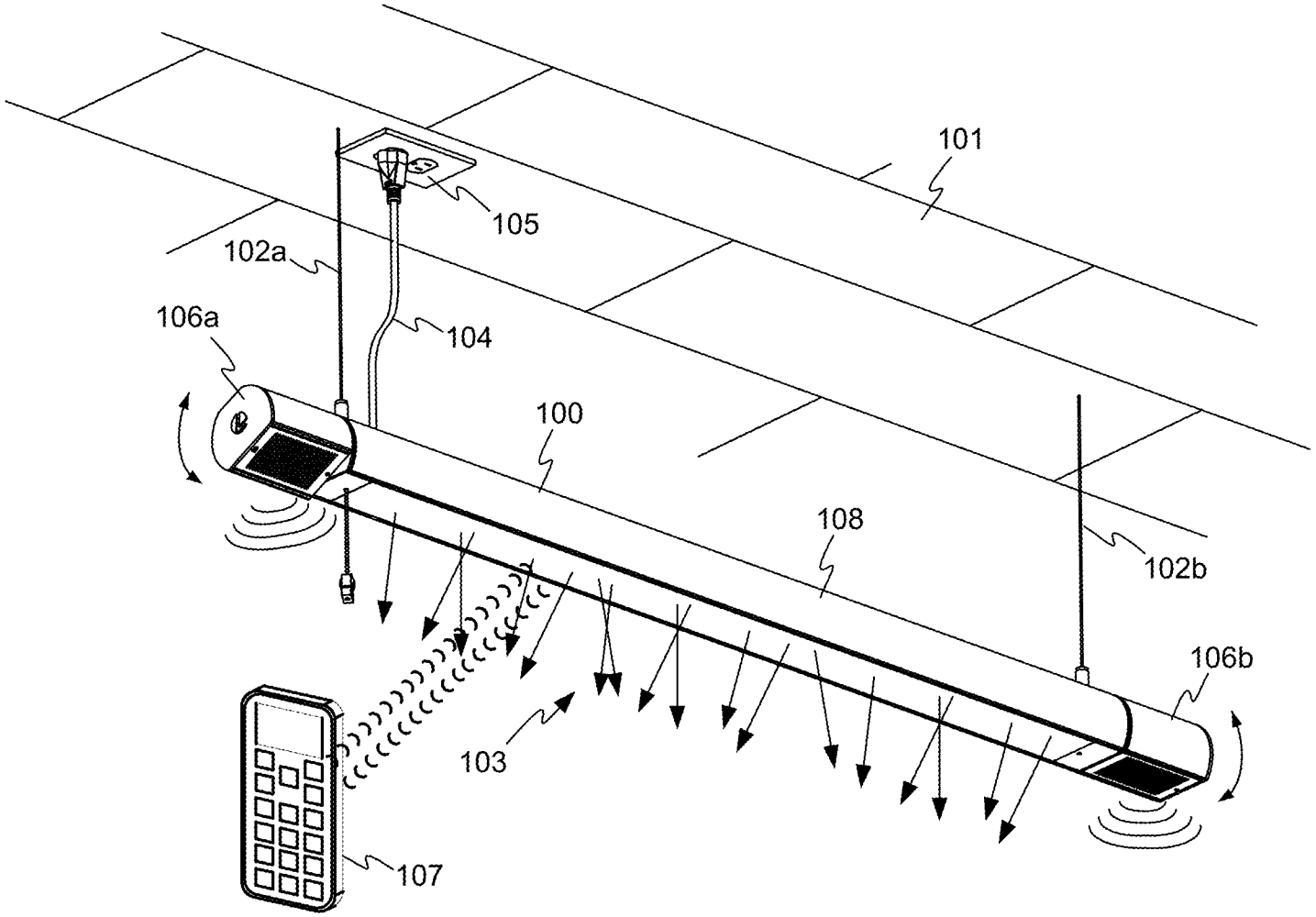
FIG. 1 depicts a light fixture in accordance with embodiments of the invention.

FIG. 1 depicts a light fixture 100 in accordance with embodiments of the invention. In this embodiment, the light fixture 100 is shown suspended from a ceiling 101 by hanging wires or chains 102*a* and 102*b*, and emitting light 103 generally downward into the room below the ceiling 101. Although other configurations are possible, example the light fixture 100 is generally elongate, and receives electrical power through a power connection such as cord 104 plugged into a mains outlet 105 in the ceiling 101. A light fixture in this general arrangement is sometimes referred to as a "shop light" because it may be used to light work areas and the like. However, the invention may be embodied in light fixtures of other configurations.

The light fixture 100 includes two speaker modules 106*a* and 106*b*, one at each end of the light fixture 100. As is described in more detail below, the light fixture 100 includes a wireless radio transceiver and an audio driver circuit, so that audio content can be transmitted to the light fixture 100, and played through the speaker modules 106*a* and 106*b*. For example, music may be streamed to the light fixture 100 from a mobile telephone 107 or other device. The light fixture thus serves dual functions. It provides light to the space, and also functions as a wireless speaker system to provide entertainment or other audio information.

The speaker modules 106*a* and 106*b* are coupled to a light fixture housing 108 of the light fixture 100 through rotatable couplings (not visible in FIG. 1), so that the speaker modules 106*a* and 106*b* are rotatable with respect to the light fixture housing 108. In FIG. 1, the speaker module 106*a* is shown in a rotated position. This rotatability allows adjustment of the principal direction of sound emitted from the speaker modules 106*a* and 106*b*. For example, if the light fixture 100 is mounted at one side of a room, the speaker modules 106*a* and 106*b* may be rotated so that sound is generally directed toward the center of the room.

Figure 2:
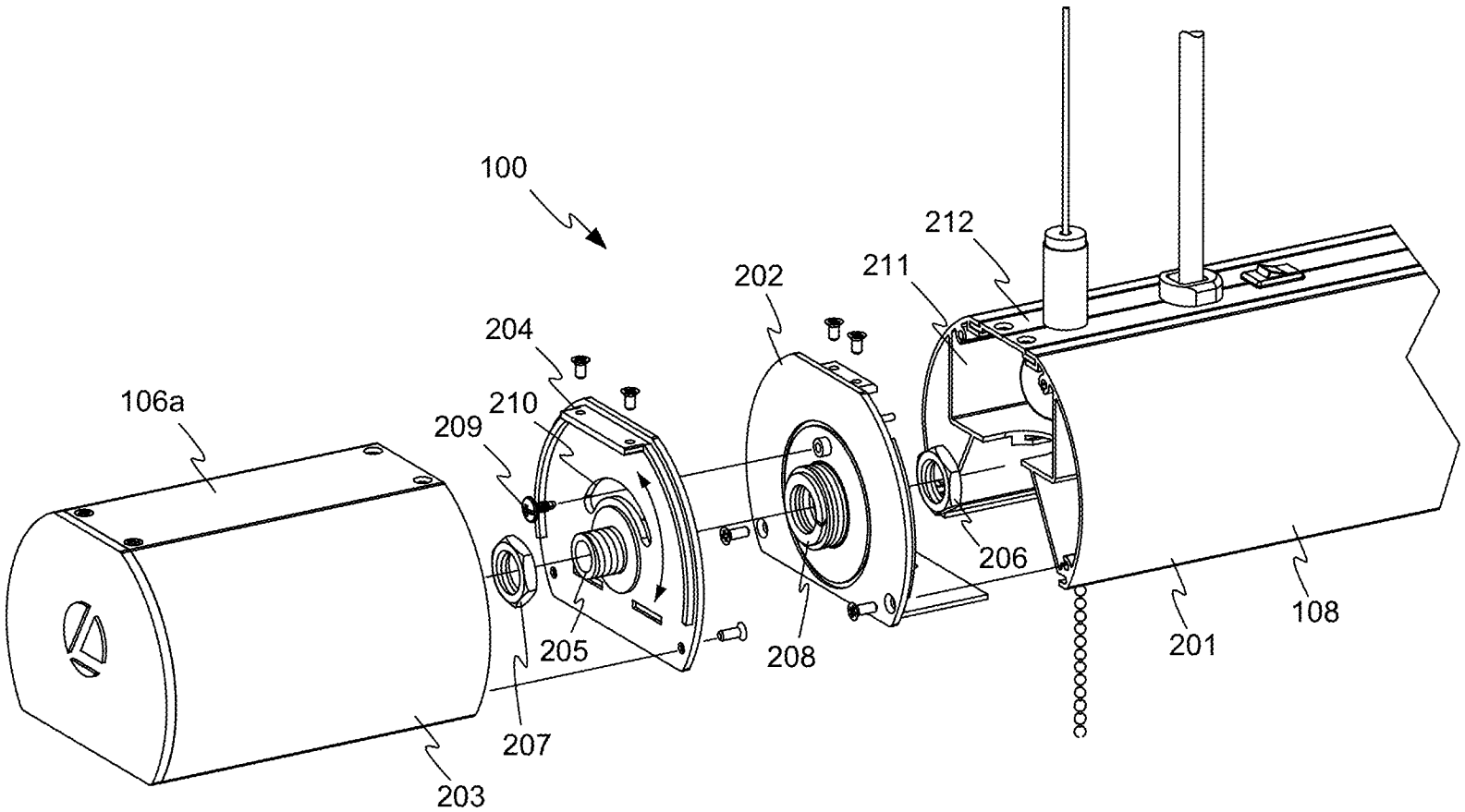
FIG. 2 illustrates the attachment of a speaker module to a housing, including a rotatable coupling, in accordance with embodiments of the invention.

FIG. 2 illustrates the attachment of the speaker module 106*a* to the light fixture housing 108, including a rotatable coupling, in accordance with embodiments of the invention. In this embodiment, the light fixture housing 108 includes an extruded main body 201. The main body 201 is made from a continuous piece of material, for example aluminum or another suitable material, and has a generally constant cross sectional perimeter shape amenable to formation by extrusion. Additional features such as screw holes, clearances, threads, and the like may be formed by secondary machining of the extruded body 201. The main body 201 lends rigidity to the light fixture 100, and includes spaces for holding a light source of the light fixture and other components, described in more detail below. A first plate 202 attaches to the main body 201, for example using screws, a snap fit, or other fastening techniques or combinations of techniques.

Similarly, the example speaker module 106*a* of FIG. 2 includes an extruded speaker housing 203 having the same cross sectional perimeter shape as the main body 201. A second plate 204 attaches to the speaker housing 203, for example in a manner similar to the attachment of the first plate 202 to the main body 201. In other embodiments, the speaker housing 203 may have a different shape than the main body 201.

A hollow rod 205 passes through both the first and second plates 202 and 204. The rod 205 is preferably threaded, so that nuts 206 and 207 can hold the two plates 202 and 204 together. A spring 208, such as a spring washer or another kind of spring, is sandwiched between the plates 202 and 204, forming a friction clutch that allows rotation of the plate 202 with respect to the plate 204 (and therefore the speaker module 106*a* with respect to the light fixture housing 108) under moderate torque, but holds the speaker module 106*a* in position on the light fixture housing 108 when no torque is applied. The rod 205 is hollow to allow passage of wires (not shown) from the light fixture housing 108 to the speaker module 106*a*.

A travel limiting screw 209 may be provided, to limit the amount of rotation that is possible between the speaker module 106*a* and the light fixture housing 108. The travel limiting screw 209 passes through a curved slot 210 in the second plate 204, and threads partially into the first plate 202, so that the ends of the curved slot 210 limit the rotation of the second plate 204 by contacting the travel limiting screw 209. The travel limiting screw 209 may also provide additional friction to the second plate 204. A spring or spring washer may be placed under the head of the limiting screw 209 for this purpose. The travel limiting screw 209 may also provide additional stability to the rotatable coupling between the main body 201 and the speaker module 106*a*.

As can be seen in FIG. 2, the extruded main body 201 forms a generally rectangular longitudinal compartment 211. A top cover 212 of the light fixture 100 closes the rectangular compartment 211.

While the example embodiment shown uses an extruded light fixture housing 108 and extruded speaker housings 203, this is not a requirement. Any other suitable materials and fabrication techniques may be used within the scope of the attached claims. For example, in other embodiments, various parts of a light fixture embodying the invention may be made from stamped sheet metal, injection molded polymer, cast or sintered metal, or any workable combination of these and other materials and fabrication techniques. More or fewer parts may be used than in the example light fixture 100 shown in FIG. 2.

Figure 3:
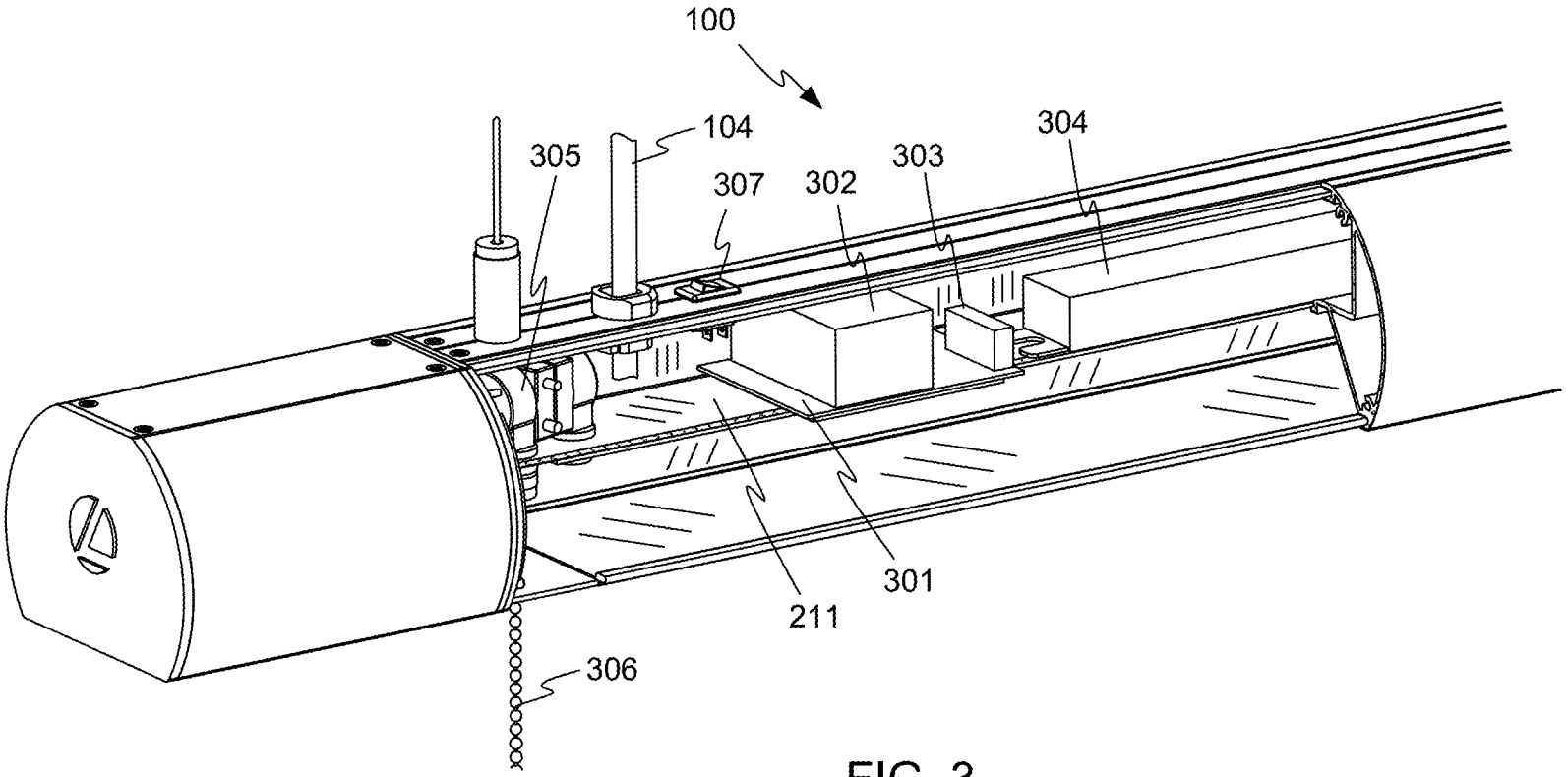
FIG. 3 shows a cutaway upper oblique view of the light fixture of FIG. 1, in accordance with embodiments of the invention.
Figure 4:
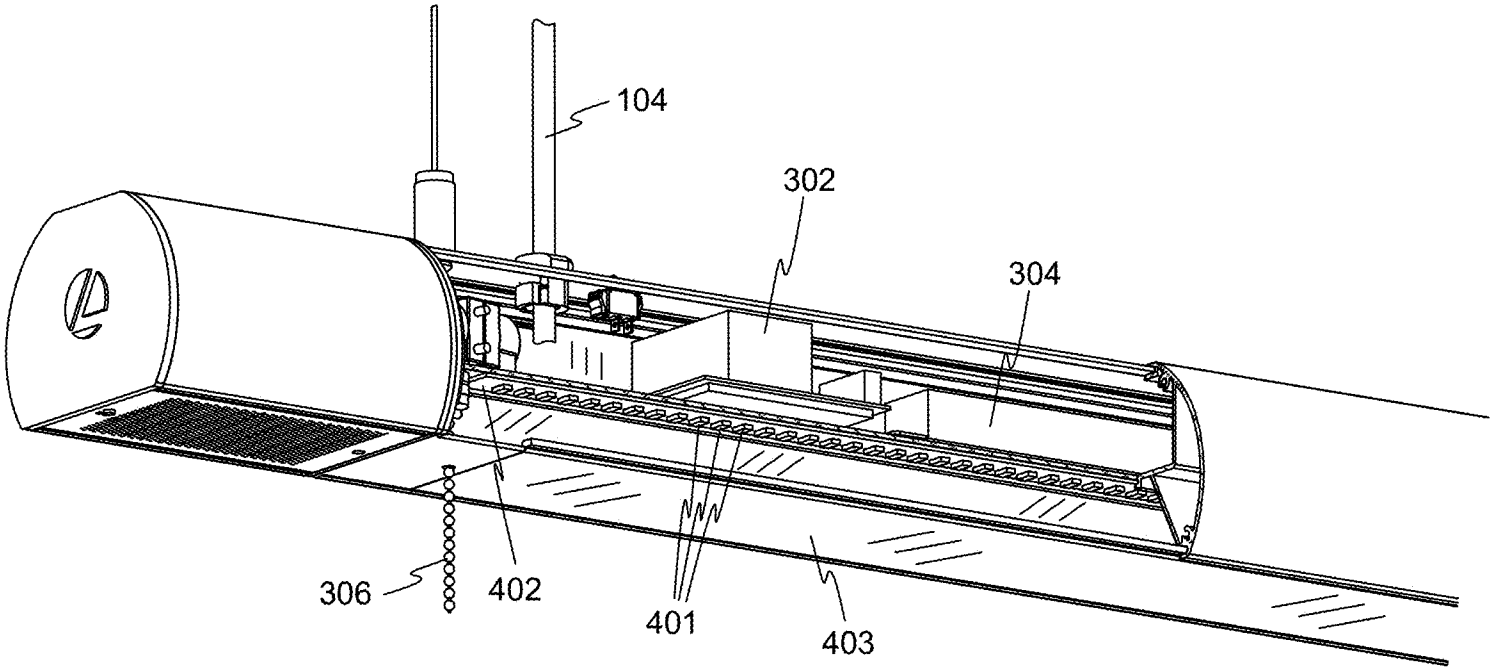
FIG. 4 shows a cutaway lower oblique view of the light fixture of FIG. 1, in accordance with embodiments of the invention.

FIG. 3 and FIG. 4 show cutaway upper and lower oblique views of a portion of the light fixture 100, in accordance with embodiments of the invention. The cutaway views show an example arrangement of some internal parts of the light fixture 100.

Referring to both FIGS. 3 and 4, a first circuit board 301 holds an audio driver circuit 302 and a wireless radio transceiver 303, and is housed in the rectangular compartment 211. A light source driver circuit 304 is also housed in the compartment 211. The light source driver circuit 304 is coupled to a number of LED light sources 401 mounted on a second circuit board 402. The LED light sources 401 emit light toward a diffuser 403, which diffuses the light and passes it to the room or other space below the light fixture 100. While the audio driver circuit 302 and the light source driver circuit 304 are shown as separate units, the two driver circuits may be combined in to a single unit in other embodiments.

Both the audio driver circuit 302 and the light source driver circuit 304 draw power through the cord 104, although internal wiring connections are not shown in FIGS. 3 and 4. A pull-chain switch 305 turns power to the light sources 401 on and off as chain 306 is actuated. Preferably, power to the audio driver circuit 302 remains on when the light sources 401 are turned off, so that the audio functions of the light fixture 100 can operate even when light is not needed.

While the pull-chain switch 305 is convenient, other kinds of switches may be used. For example, a rocker switch, a toggle switch, or another kind of switch may be placed on an outside wall of the light fixture 100 and configured to turn the lighting portion of the light fixture 100 on and off. In some embodiments, the light fixture 100 could be plugged into a switched outlet, and the light fixture 100 may be turned on and off using a wall switch. In that case, any switch built into the light fixture 100 may be left in the "on" position.

In some embodiments, the spectral content of the light produced by the light sources 401 can be adjusted. For example, light sources are sometimes categorized by their color temperature. The color temperature of a light source is the temperature of an ideal black body radiator that emits light of approximately the same color as the light source. A color temperature of 2700K gives a light that is similar to that produced by traditional incandescent bulbs, and is sometimes described as "warm" light. Other light sources may have color temperatures of 3000K, 4000K, 5000K, or other color temperatures. In general, a higher color temperature indicates a higher ratio of blue to red content in the emitted light, and the light produced by higher color temperature light sources is sometimes described as "cool" light.

In the light fixture 100, a switch 307 may be provided for changing the spectral content of the light produced by the light fixture 100. The position of the switch 307 may be detected by the light source driver circuit 304, which may drive the light sources 401 differently in response to the position of the switch 307, to produce light of different color character. In other embodiments, the light fixture 100 may include a dial, sliding control, or other input device that enables continuous adjustment of the spectral content of the light produced by the light fixture 100 rather than providing only two fixed choices.

Figure 5:
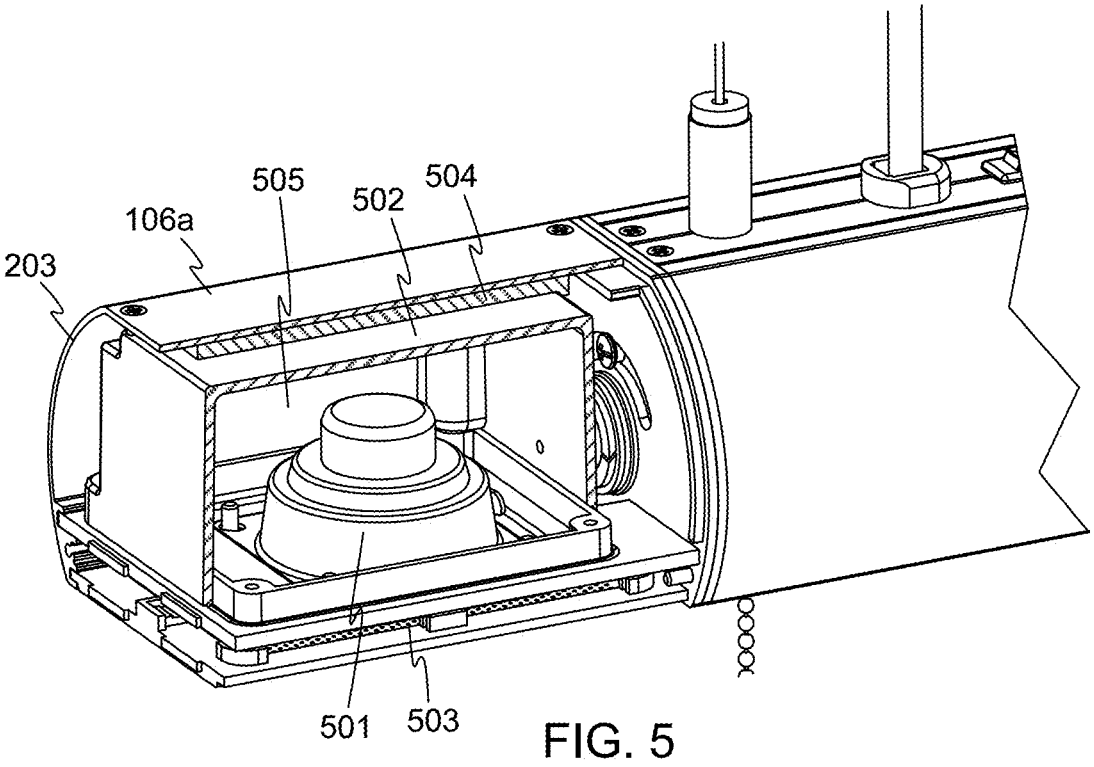
FIG. 5 illustrates an upper oblique cutaway view of the speaker module of FIG. 2, showing some additional internal details.

FIG. 5 illustrates an upper oblique cutaway view of the speaker module 106*a*, showing some additional internal details. A speaker 501 is enclosed in a speaker cavity 505 by a speaker enclosure 502 and directed toward grille 503. A foam pad 504 may be positioned between the speaker enclosure 502 and the outer speaker housing 203.

Figure 6:
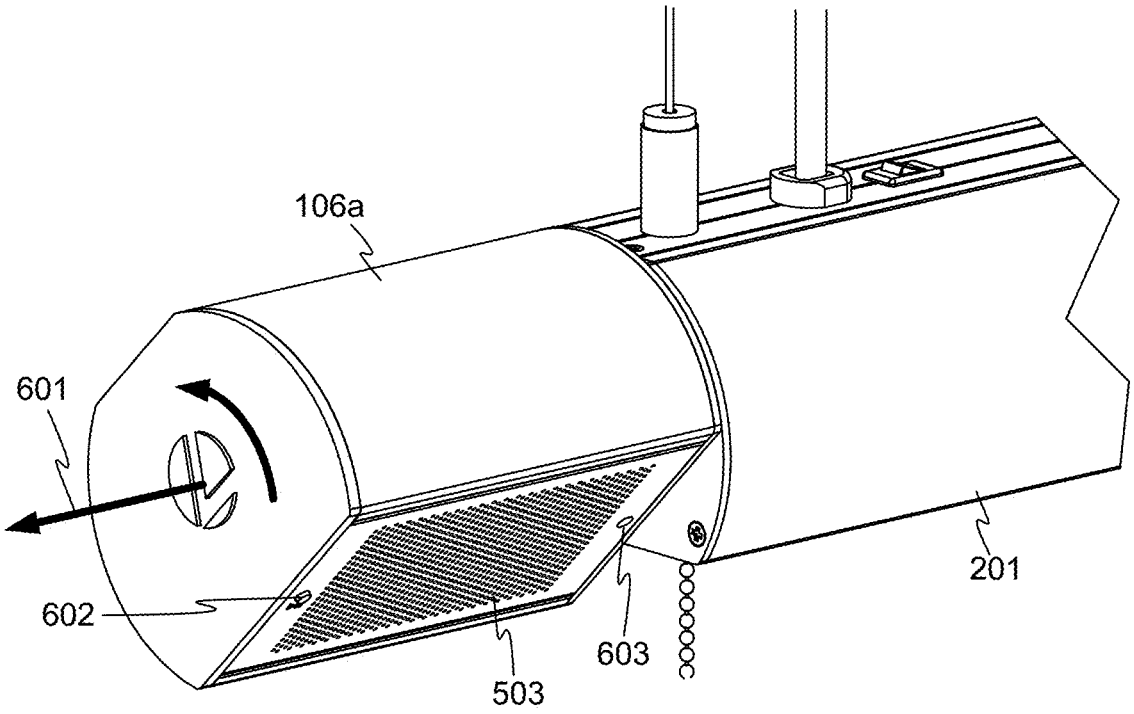
FIG. 6 illustrates a lower oblique view of the speaker module of FIG. 2.

FIG. 6 illustrates a lower oblique view of the speaker module 106*a*. In FIG. 6, the speaker module 106*a* has been rotated 45 degrees about a longitudinal axis 601 of the main body 201 of the light fixture 100. Grille 503 is visible from its outer side. The longitudinal axis 601 is the axis about which the speaker modules rotate, and need not be an axis of symmetry of any part of the light fixture 100.

In some embodiments, the light fixture 100 may include a button 602, enabling manual input to the light fixture 100. For example, the audio driver circuit 302 may have a wireless capability such as Bluetooth® capability, that utilizes pairing between devices that wish to communicate. The button 602 may be used to initiate or accept pairing from an external device such as the mobile telephone 107 shown in FIG. 1. In other cases, the button 602 may be used to play or pause audio content being streamed to the audio driver circuit 302, or for other purposes.

In some embodiments, the light fixture 100 may include a microphone. In the embodiment of FIG. 6, an aperture 603 for allowing sound to reach a microphone within the speaker module 106*a* is provided on the speaker module 106*a*. The microphone (not visible) may enable two-way audio communication with the light fixture 100. For example, the light fixture 100 may act as a "hands free" communication device for conducting telephone calls through the mobile telephone 107. In some embodiments, the button 602 or another control may be used for answering or disconnecting incoming calls from the mobile telephone 107 or a similar device.

Figure 7:
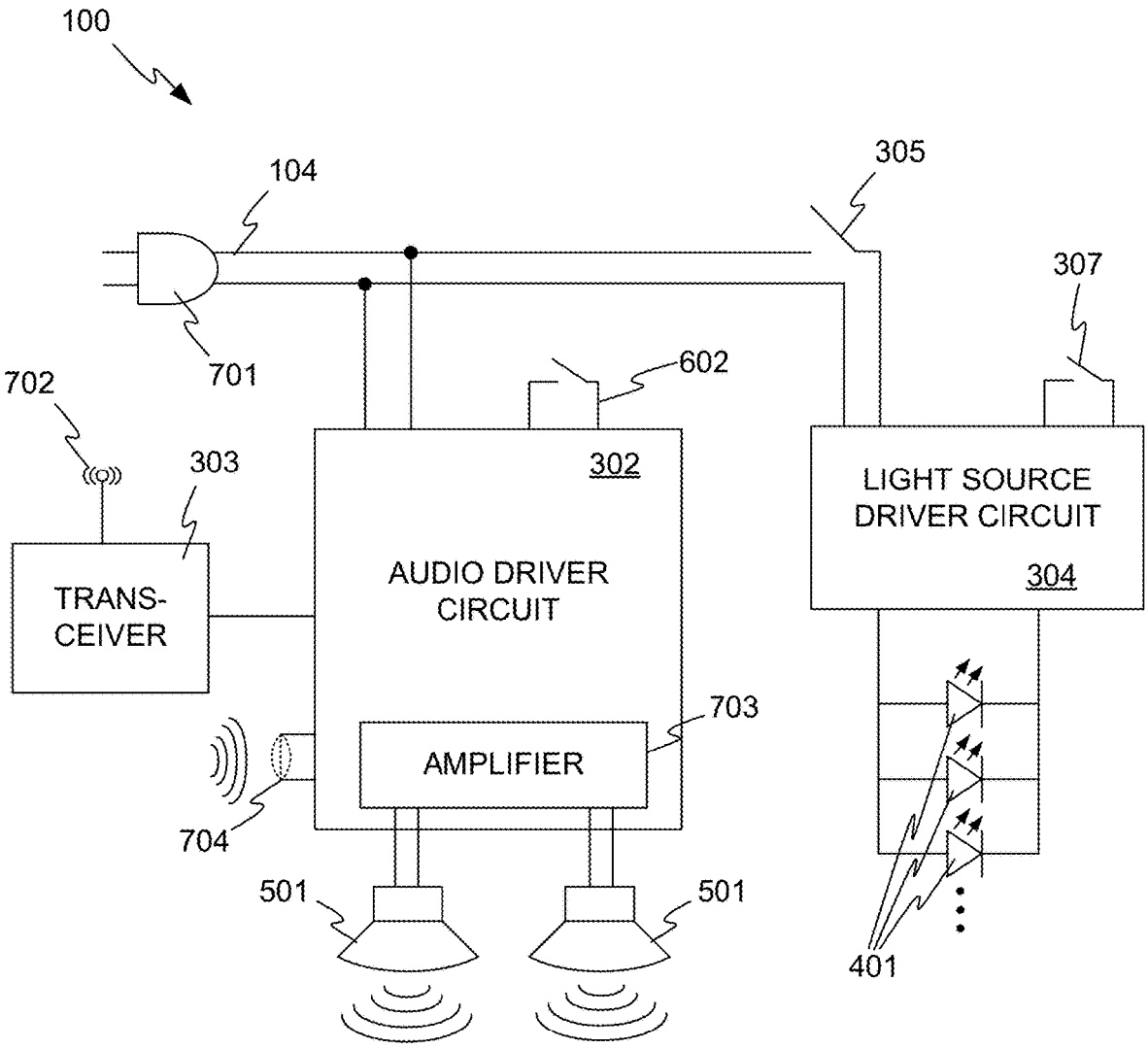
FIG. 7 illustrates a simplified block diagram of an electronic architecture of the light fixture of FIG. 1, in accordance with embodiments of the invention.

FIG. 7 illustrates a simplified block diagram of an electronic architecture of the light fixture 100, in accordance with embodiments of the invention. Mains power is received via the cord 104, for example through a plug 701. In other embodiments, the light fixture 100 may be directly connected to the building wiring. While the example light fixture 100 receives mains power, for example 110 V AC, in other embodiments DC power may be supplied. A light fixture receiving mains power is sometimes called a "line voltage" fixture, and a light fixture receiving DC power is sometimes called a "low voltage" fixture.

The audio driver circuit 302 may typically operate on low voltage DC power, for example 12 V DC, so the audio driver circuit 302 may contain a transformer or other power converter (not shown) to generate the needed DC voltage. Similarly, when LED light sources are used, such as the light sources 401, then the light source driver circuit 304 needs DC power as well. The light source driver circuit 304 may also contain a transformer or other converter. In other embodiments, a single transformer or converter may provide DC power to both the audio driver circuit 302 and the light source drive circuit 304.

The switch 305 interrupts the power to the light source driver circuit 304, to turn the light sources 401 on and off. As shown, the switch 305 does not interrupt power being supplied to the audio driver circuit 302, so that the audio functions of the light fixture 100 can operate when the lights are off. In other embodiments, the switch may interrupt power to both the light source driver circuit 304 and the audio driver circuit 302.

The wireless radio transceiver 303 includes an antenna 702, for wireless communication. For example, the wireless radio transceiver may be a Bluetooth® transceiver enabling bi-directional wireless communication with other devices. In other embodiments, other kinds of radio transceivers may be used, for example a WiFi® transceiver, or another standard kind of transceiver, or a proprietary transceiver. The wireless radio transceiver 303 may receive signals representing audio content for the audio driver circuit 302.

Received audio content may be played through the speakers 501 via an amplifier 703. Preferably, at least two speakers 501 are present, enabling stereo sound.

Sound may be received through a microphone 704 and converted to wireless signals representing the sound, for transmission via the transceiver 303. The button 602 may be used for manual communication with the audio driver circuit 302, for example to initiate pairing with an externals device.

In a simple embodiment, the light source driver circuit 304 supplies power to the light sources 401 when the switch 305 is in the on position. In the embodiment shown in FIG. 7, the switch 307 may be used to configure the light source driver circuit, for example to change the spectral content of the light generated by the light fixture 100. The light source driver circuit 304 can detect the state of the switch 307 (open or closed) and can operate in one of two states accordingly.

When the switch 307 is used to indicate a change in the spectral content of the light being generated, the change may be accomplished in any suitable way. For example, different ones of the light sources 401 may include different phosphors for generating light in different parts of the visible spectrum. Differing amounts of current may be provided to the different light sources, to change the weighting of the different parts of the spectrum in the generated light. For example, to generate a "warm" light, the light sources 401 having red phosphors may be given more current in relation to light sources having shorter-wavelength phosphors.

Figure 8:
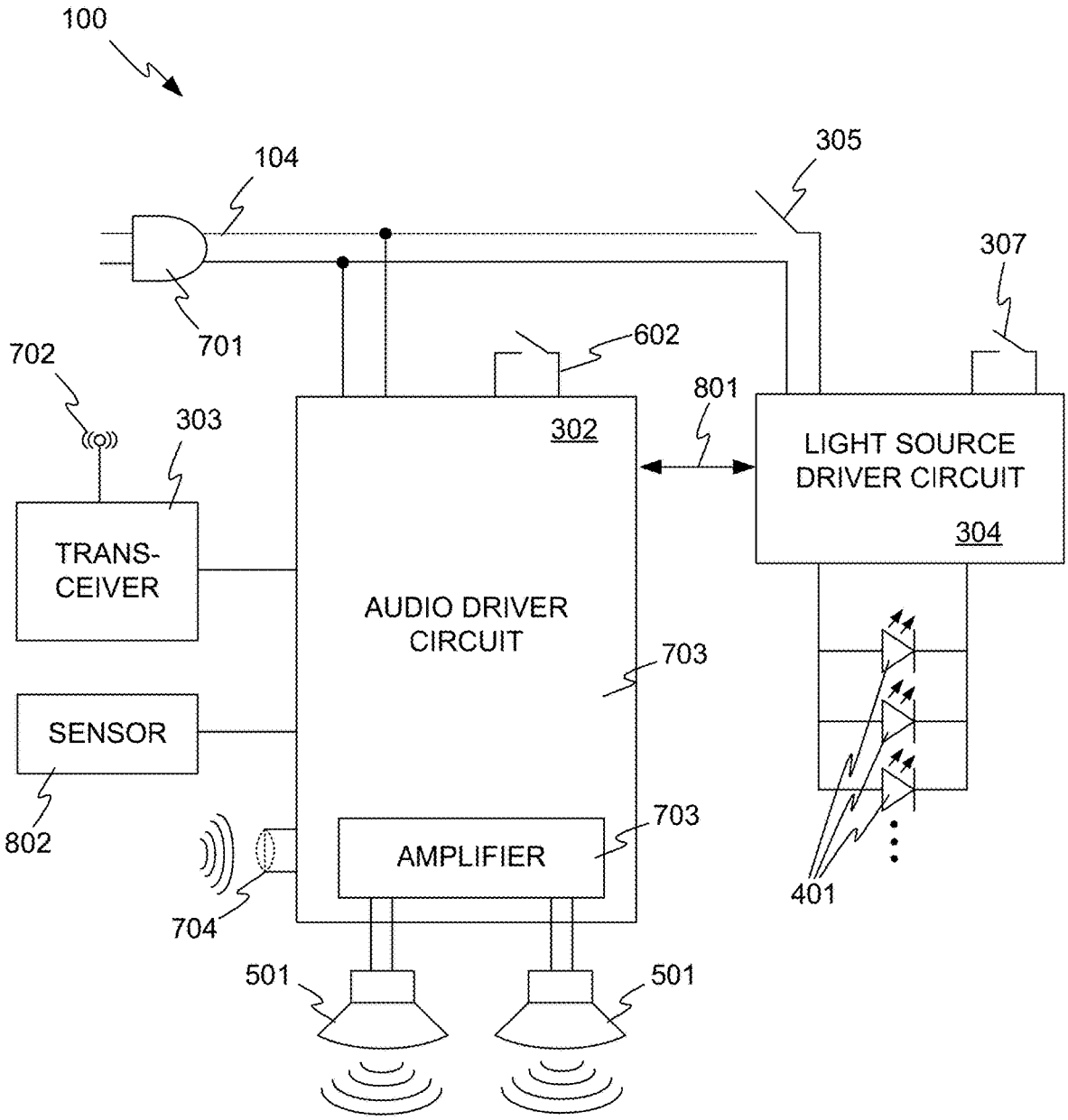
FIG. 8 illustrates a simplified block diagram of an electronic architecture of the light fixture of FIG. 1, in accordance with other embodiments of the invention.

In the embodiment of FIG. 7, the audio driver circuit 302 and the light source driver circuit 304 operate independently, other than receiving power from the same ultimate source. FIG. 8 illustrates a simplified block diagram of an electronic architecture of the light fixture 100 in accordance with other embodiments of the invention. The architecture of FIG. 8 is similar in many ways to the architecture of FIG. 7, with the addition of a communication link 801 between the audio driver circuit 302 and the light source driver circuit 304. The communication link 801 may be a standard interface such as a Universal Serial Bus (USB) interface or another standardized interface or a proprietary interface.

The communication link 801 may enable other capabilities of the light fixture 100. For example, a user may transmit a command via the wireless transceiver 303 for the light sources 401 to be turned on or off. In another example, the light source driver circuit 304 may include a dimming capability, and a user may transmit a command to dim the light sources 401. Commands may be sent from a communication devices such as the mobile telephone 107 shown in FIG. 1, executing an application program for controlling the light fixture 100.

The audio driver circuit 302 may relay the command through the communication link to the light source driver circuit 304, which can implement the command (presuming the switch 305, if present, is in the "on" position). Either or both of the audio driver circuit 302 and the light source driver circuit 304 may contain sufficient circuitry to perform their functions. For example, either may contain a microprocessor and memory holding instructions executable by the processor to implement the capabilities of the respective circuit, or other kinds of control circuitry capable of operating the respective circuit.

In another example use of the communication link 801, the audio driver circuit 302 may analyze the received audio signals, and command the light source driver circuit 304 to operate in reaction to the analysis. For example, the audio driver circuit 302 may perform a spectrum analysis of the incoming audio signals, and may command the light source driver circuit based on the results of the spectrum analysis. In one embodiment, the light fixture 100 may momentarily brighten the light sources 401 when a low-frequency (bass) pulse is detected in the audio content, to achieve a strobe-like effect. In other embodiments, the light fixture 100 may adjust the brightness of the light sources 401 in relation to the volume of the audio content.

In other embodiments, the color of the light being produced by the light sources 401 may react to the frequency content, volume, or another aspect of the audio content. Any workable combination of these and other relationships between the audio content and the light being produced may be implemented.

Also shown in FIG. 8 is a sensor 802. The sensor 802 may be, for example a motion detector that detects motion of an object in the room in which the light fixture 100 is installed, or a sensor that detects the presence of a body within the room. The light fixture 100 may be configured to act on the output of the sensor. For example, the light fixture may turn on the light sources 401 when presence or motion is detected. In another example, the light fixture may emit a sound when presence or motion is detected, for example a loud sound suitable to serve as a burglar alarm. The light fixture may be configurable to enable or disable different responses to the sensor inputs, for example using the mobile telephone 107 to communicate with the light fixture 100 and configure it. For example, a homeowner may put the light fixture 100 into burglar alarm mode at night, but may turn off the burglar alarm mode during the day when the room is commonly used. A sensor such as the sensor 802 may be present in any of the embodiments. Other kinds of sensors may be used as well, for example a temperature sensor, a smoke sensor, or another kind of sensor. Multiple sensors may be present.

Figure 9:
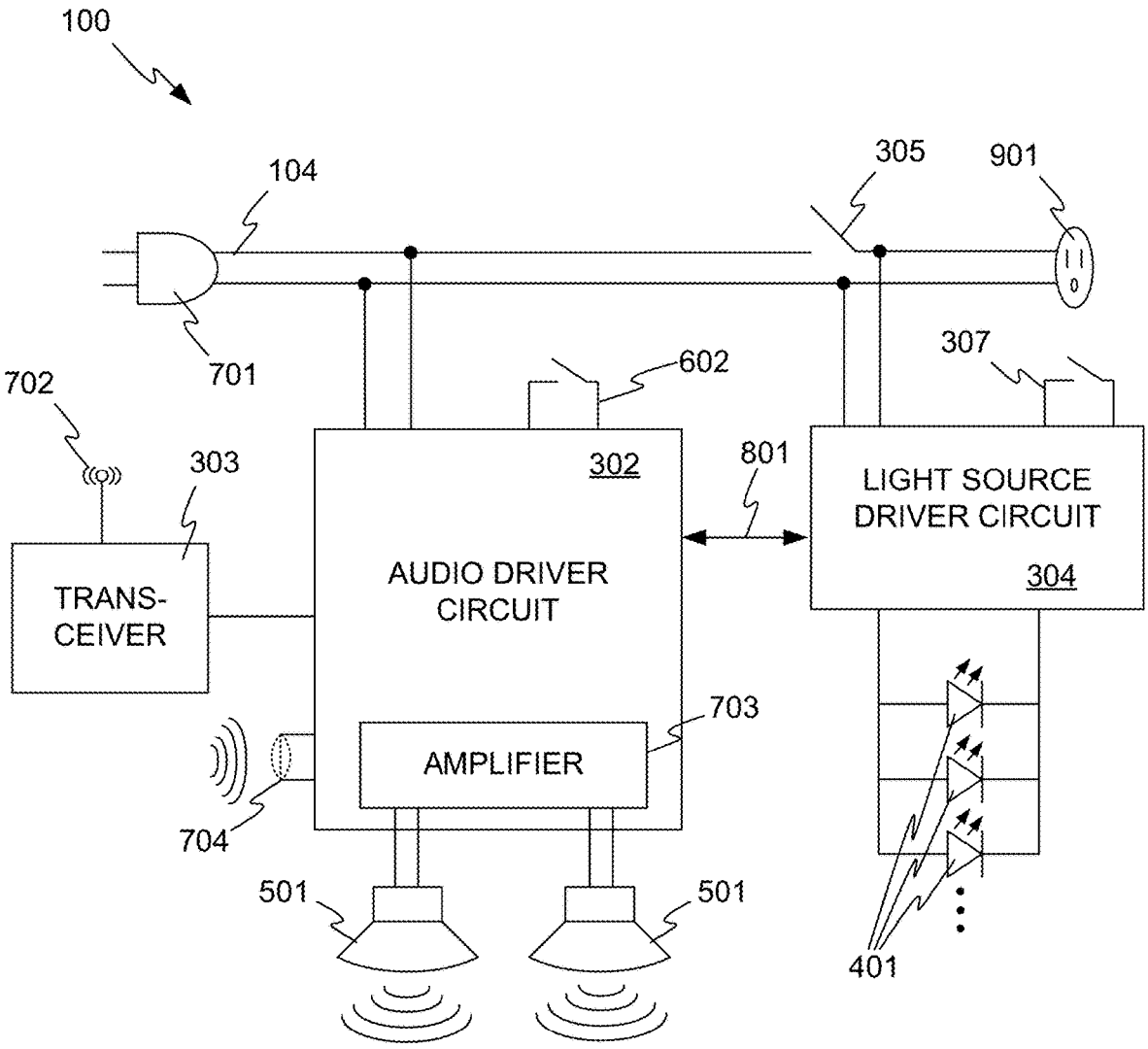
FIG. 9 illustrates a simplified block diagram of an electronic architecture of the light fixture of FIG. 1, in accordance with other embodiments of the invention.

FIG. 9 illustrates a simplified block diagram of an electronic architecture of the light fixture 100 in accordance with other embodiments of the invention. The architecture of FIG. 9 is similar in many ways to the architectures of FIGS. 7 and 8, with the addition of an output connection 901. In this example, the output connection 901 is a mains power outlet. Two similar or identical light fixtures 100 according to the embodiment of FIG. 9 may be connected in "daisy chain" fashion, to share a single mains electrical outlet.

Figure 10:
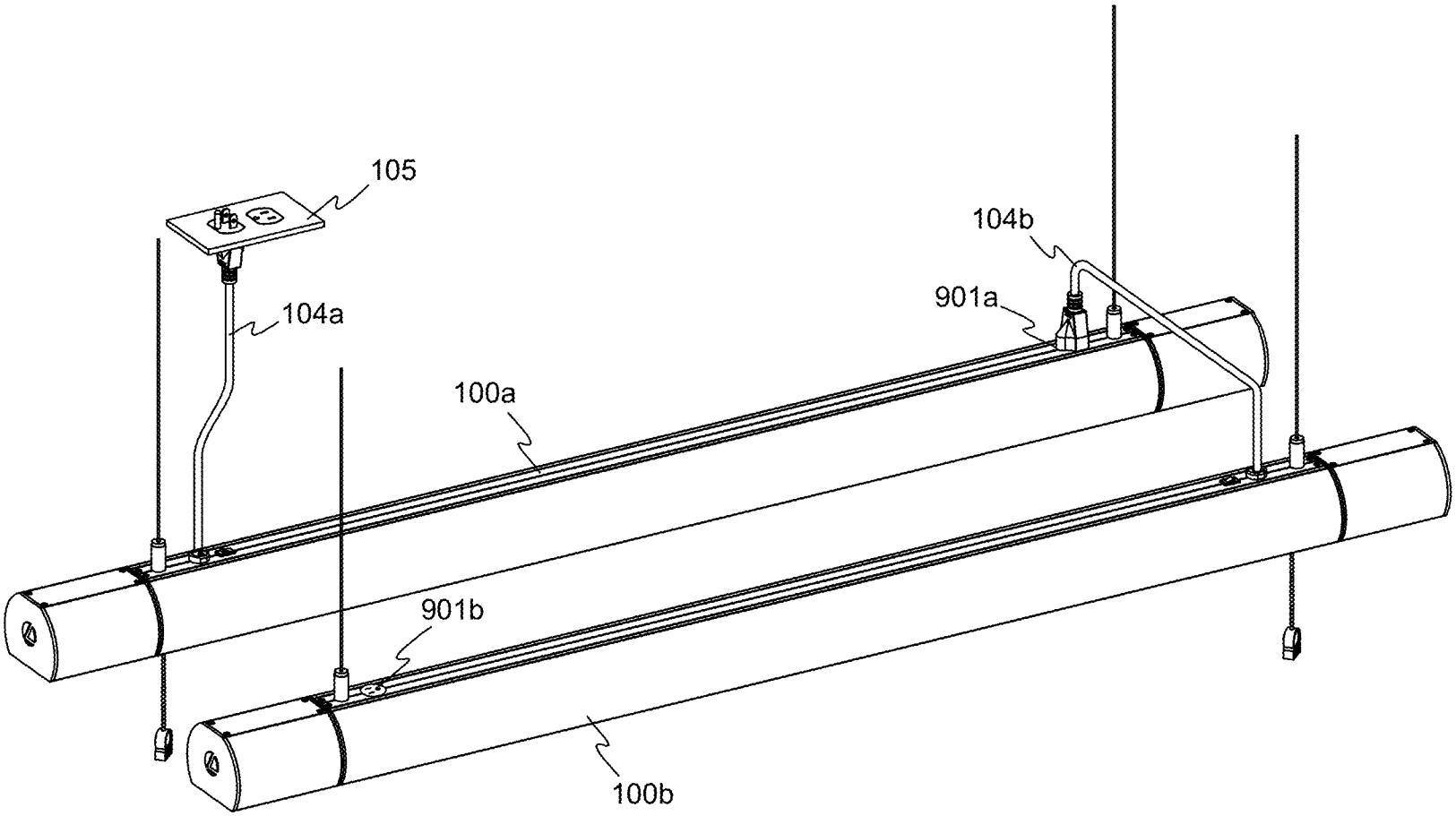
FIG. 10 shows two light fixtures connected together, in accordance with embodiments of the invention.

FIG. 10 shows such an arrangement. In FIG. 10, a first light fixture 100*a* includes a power cord 104*a*, plugged into the mains outlet 105. The light fixture 100*a* includes a power output connect 901*a*. A second light fixture 100*b* includes a power cord 104*b*, which is plugged into the outlet connection 901*a* of the first light fixture 100*a*. The second light fixture 100*b* also includes an output connection 901*b*, into which yet another light fixture could be plugged if desired. The output connections could be used to power other devices as well.

Figure 11:
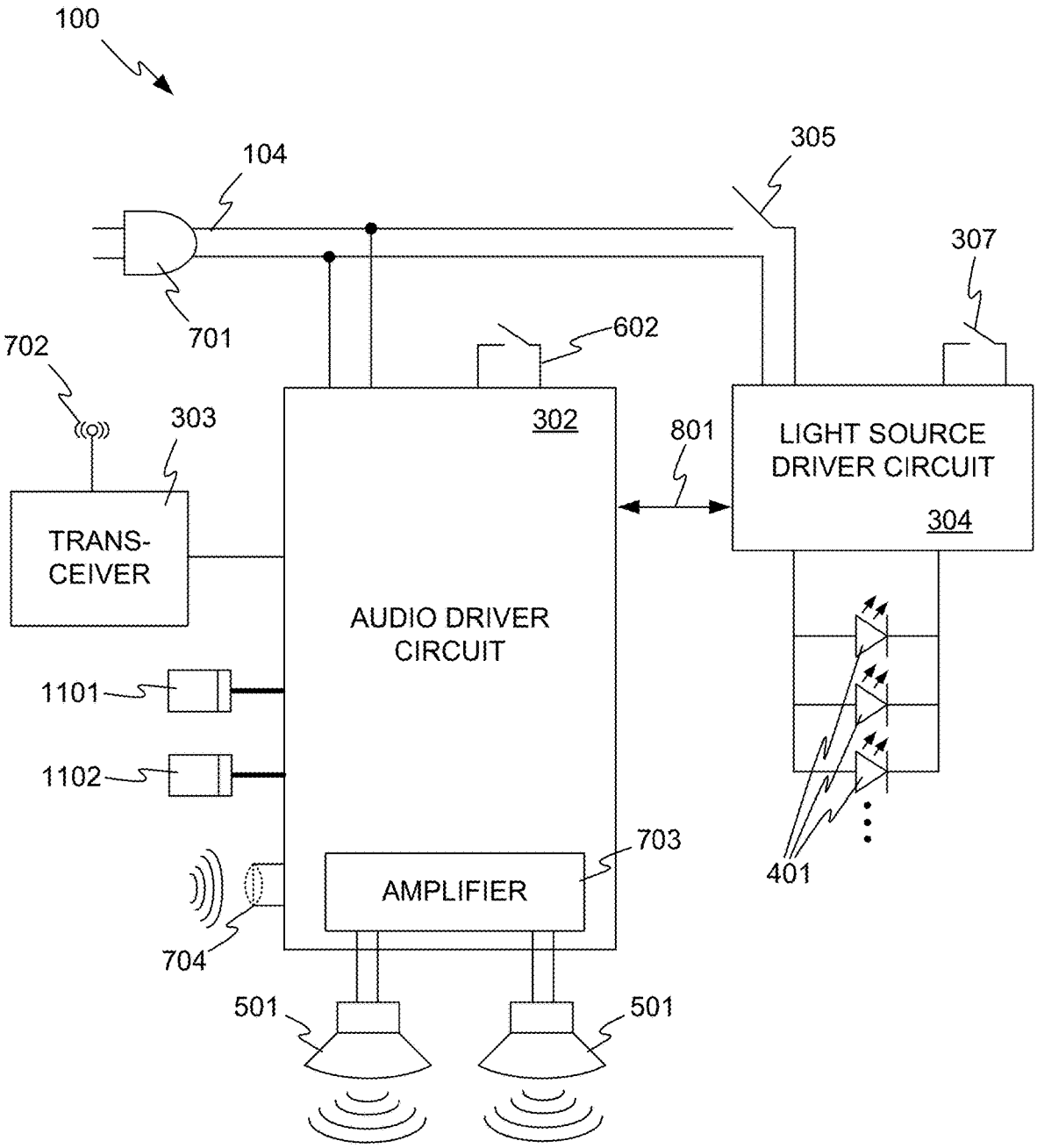
FIG. 11 illustrates a simplified block diagram of an electronic architecture of the light fixture of FIG. 1, in accordance with another embodiment.

In other embodiments, the light fixture 100 may include input and output connections that provide a communication capability. FIG. 11 illustrates a simplified block diagram of an electronic architecture of the light fixture 100 in accordance with such an embodiment. The architecture of FIG. 11 is similar in many ways to the architectures of FIGS. 7 and 8, with the additions of an input connection 1101 and an output connection 1102. The input and output connections 1101 and 1102 may be, for example, male and female USB connectors, and the audio driver circuit 302 may be configured to communicate through the respective USB interfaces. Any other suitable kind of connections may also be used. Similar or identical light fixtures 100 may be connected in daisy chain fashion and communicate with each other via the input and output connections 1101 and 1102.

Figure 12:
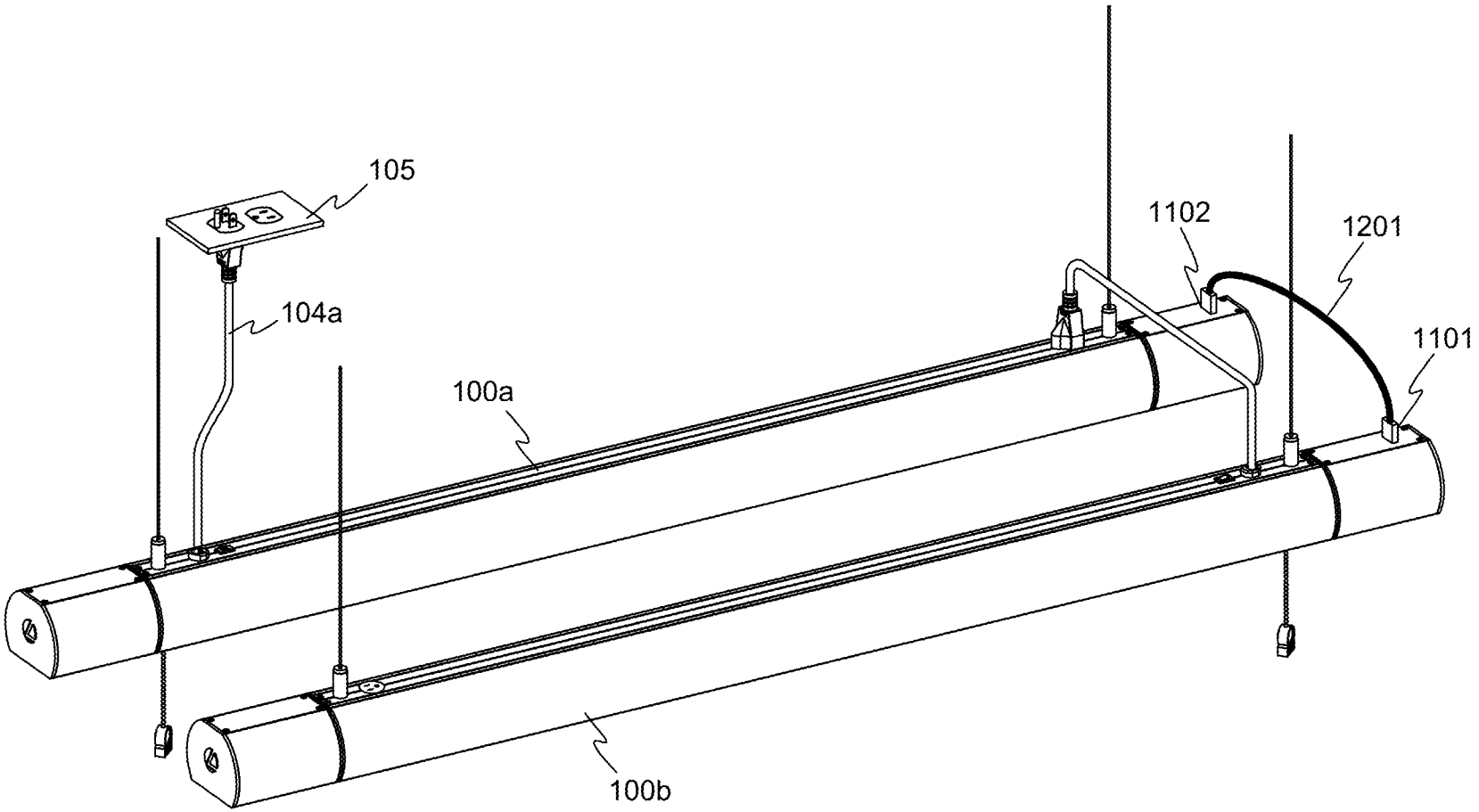
FIG. 12 shows two light fixtures connected together, in accordance with other embodiments of the invention.

FIG. 12 shows such an arrangement. In FIG. 12, a first light fixture 100*a* includes a power cord 104*a*, plugged into the mains outlet 105. The light fixture 100*a* includes an output connection 1102. A second light fixture 100*b* includes an input connection 1101. A cable 1203 is plugged between the two connections, enabling communication between the two light fixtures 100*a* and 100*b*. The communication capability may be used in any workable manner. For example, one of the light fixtures, such as the first light fixture 100*a*, may be designated the primary light fixture, and the second light fixture 100*b* may be designated the secondary light fixture. The primary light fixture 100*a* may send commands to the secondary light fixture 100*b*. For example, the primary light fixture 100*a* may be configured to pulse the brightness of its light sources in response to bass notes in music being played through the first light fixture 100*a*. The primary light fixture 100*a* may send commands to the secondary light fixture 100*b* to pulse the brightness of its light sources synchronously with the pulsing of the primary light fixture 100*a*. In another example, the primary light fixture 100*a* may be connected to a dimmer, and may signal the secondary light fixture 100*b* to dim its light sources to the same level as those of the primary light fixture 100*a*. In yet another example, the primary light fixture 100*a* may be receiving music streamed from a device such as the mobile telephone 107 shown in FIG. 1. The primary light fixture 100*a* may relay the received audio content to the secondary light fixture 100*b*, for playing through the speakers of the secondary light fixture 100*b* at the same time. Many different applications of the communication capability provided by the input and output connection may be envisioned. Any workable number of similar or identical light fixtures may be connected together in this way.

As is shown in FIG. 12, both the daisy chained power connection and the daisy chained communication connection could be provided. In other embodiments, only the daisy chained communication connection may be provided. When both are present, the power and communication connections may use separate cables (as shown in FIG. 12), or could be combined in a single cable.

In some embodiments, the light fixture 100 may communicate wirelessly with other nearby light fixtures, for example using the transceiver 303. This wireless communication enables other possible uses of the light fixture 100. For example, the light fixture 100 could be instructed (such as using the mobile telephone 107 of FIG. 1) to pair with a similar light fixture 100 in an adjacent room, and to provide an intercom capability. In this application, sound received by the microphone 704 of either of the paired light fixtures 100 is digitized and sent wirelessly to the other of the paired light fixtures 100, where it is played through the speakers 501 of the other light fixture 100. Persons in the two rooms can carry on a two-way conversation through the paired light fixtures, as through an intercom system.

Figure 13:
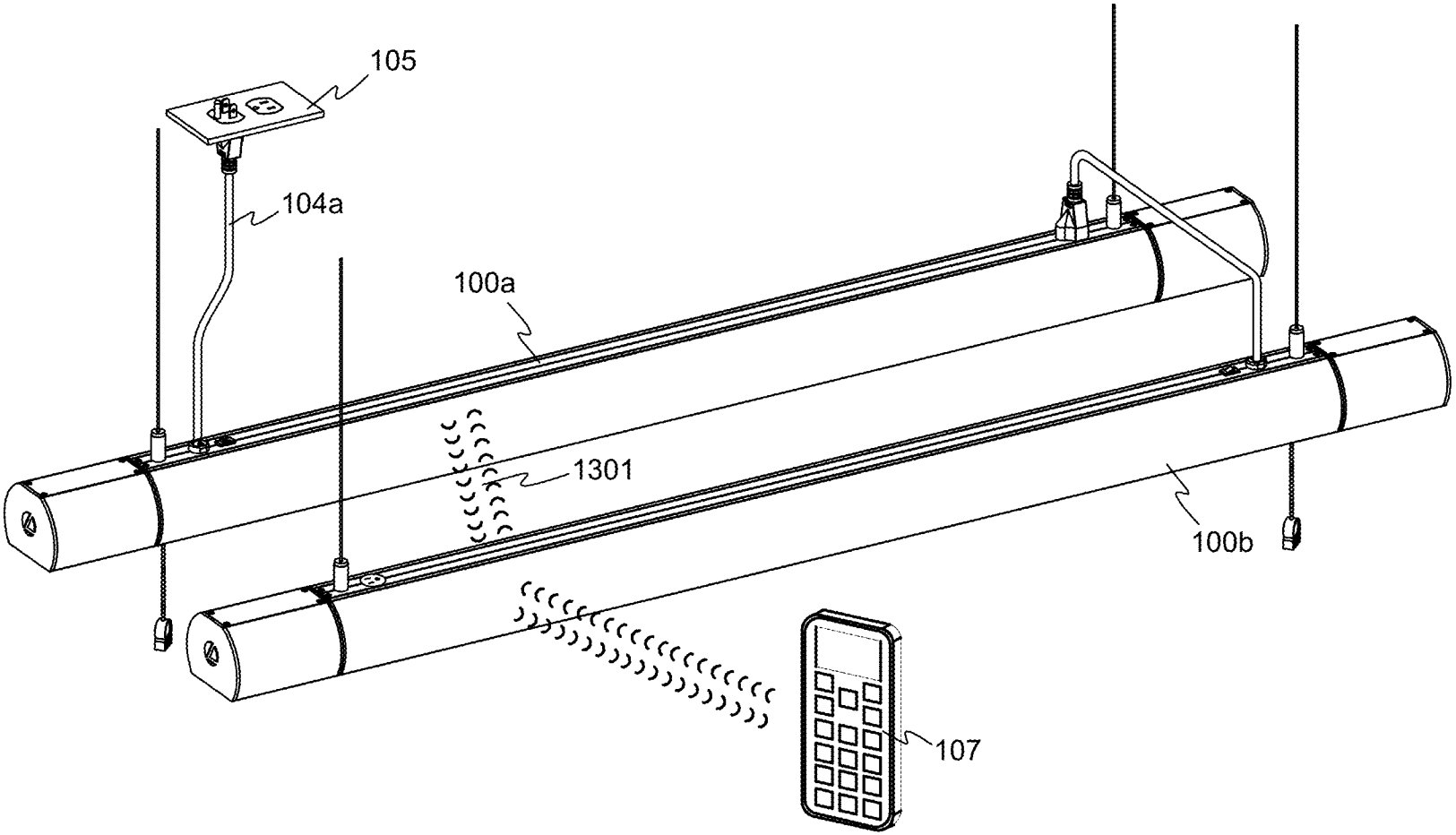
FIG. 13 illustrates two light fixtures wirelessly communicating, in accordance with embodiments of the invention.

In another example, a wireless connection may replace the wired connection 1201 described in relation to FIG. 12. The two adjacent light fixtures 100*a* and 100*b* may communicate wirelessly to implement any of the functions disclosed above, for example synchronizing lighting effects to music, synchronizing dimming of the two light fixtures, playing music received by one of the light fixtures simultaneously though both, or other functions. This arrangement is shown in FIG. 13, where the second light fixture 100*b* is in bidirectional wireless communication with the mobile telephone 107, and the two light fixtures 100*a* and 100*b* are in bidirectional wireless communication 1301 with each other. While the second light fixture 100*b* is shown receiving power from the first light fixture 100*a*, this is not a requirement. The second light fixture 100*b* could be plugged into any available receptacle, or could receive power through direct wiring, for example.

In another embodiment, wirelessly-coupled light fixtures 100 may form a wireless mesh network, providing data transfer capability between devices throughout a facility.

It will be apparent to those skilled in the art that various modifications and variations can be made in the method and system of the present invention without departing from the spirit or scope of the invention. Thus, it is intended that the present invention include modifications and variations that are within the scope of the appended claims and their equivalents. It is to be understood that any workable combination of the features and capabilities disclosed herein is also considered to be disclosed.

What is claimed is:

1. A light fixture, comprising:

a light fixture housing, wherein the light fixture housing is elongate and has a longitudinal axis, a first end, and a second end opposite the first end;

one or more light sources housed in the light fixture housing;

a power connection for receiving electric power for the one or more light sources;

a light source driver circuit configured to receive power from the power connection and to drive the one or more light sources to produce light;

an audio speaker module coupled to the first end of the light fixture housing through a rotatable coupling, wherein the audio speaker module comprises a speaker housing;

a wireless radio transceiver configured to receive transmissions of audio content to be played through the audio speaker module; and an audio driver circuit configured to receive power from the power connection and to drive the audio speaker module to produce audio output of the audio content;

wherein the audio speaker module is rotatable with respect to the light fixture housing via the rotatable coupling to adjust the principal direction of sound emitted from the speaker module.

2. The light fixture of claim 1, wherein:

the audio speaker module is a first audio speaker module and the rotatable coupling is a first rotatable coupling, and the light fixture further comprises a second audio speaker module and a second rotatable coupling;

the second audio speaker module is positioned at the second end of the light fixture housing and coupled to the light fixture housing via the second rotatable coupling of the second audio speaker module; and each of the first and second audio speaker modules is rotatable about the longitudinal axis via the respective one of the rotatable couplings.

3. The light fixture of claim 1, further comprising a switch actuatable to switch the one or more light sources on and off, wherein the audio driver circuit remains powered when the one or more light sources are switched off.

4. The light fixture of claim 1, wherein the light source driver circuit and the audio driver circuit are not communicatively coupled together.

5. The light fixture of claim 1, wherein the light source driver circuit and the audio driver circuit are communicatively coupled together.

6. The light fixture of claim 5, wherein the light source driver circuit and the audio driver circuit are coupled together such that one or more characteristics of the light emitted by the one or more light sources are responsive to one or more characteristics of the audio content.

7. The light fixture of claim 6, wherein the one or more characteristics of the light emitted by the one or more light sources are selected from the group of characteristics consisting of a brightness of the light and a spectral content of the light.

8. The light fixture of claim 6, wherein the one or more characteristics of the audio content are selected from the group of characteristics consisting of a volume of the audio content and a frequency content of the audio content.

9. The light fixture of claim 1, further comprising a microphone coupled to the audio driver circuit, and wherein the light fixture is configurable to:

play audio content received via the wireless radio transceiver through the audio speaker module; and convert sound received via the microphone to electrical signals and to transmit the electrical signals via the wireless radio transceiver.

10. The light fixture of claim 9, wherein the audio driver circuit is configured to pair with an external wireless communication device to provide hands free communication via the external wireless communication device.

11. The light fixture of claim 1, wherein a spectral content of the light produced by at least one of the one or more light sources is adjustable.

12. The light fixture of claim 1, further comprising an input connection and an output connection, the input and output connections configured such that the light fixture can be coupled to another light fixture by connecting the input connection of the light fixture to the output connection of the another light fixture, or by connecting the output connection of the light fixture to the input connection of the another light fixture.

13. The light fixture of claim 12, wherein the input connection is of the light fixture configured to receive power from the output connection of the another light fixture for powering the light source driver circuit and the audio driver circuit of the light fixture.

14. The light fixture of claim 12, wherein the input connection of the light fixture is configured to receive audio communication signals from the output connection of the another light fixture.

15. The light fixture of claim 1, wherein the light fixture housing comprises an extruded main body having a cross sectional perimeter shape, and wherein the speaker housing of the audio speaker module comprises cross sectional perimeter shape substantially the same as the cross sectional perimeter shape of the main body.

16. The light fixture of claim 1, wherein the rotatable coupling of the audio speaker module comprises:

a first plate attached to the light fixture housing;

a second plate attached to the speaker housing; and a hollow rod about which the second plate can rotate with respect to the first plate;

wherein wires pass through the hollow rod to connect the speaker module to the audio driver circuit.

17. The light fixture of claim 1, further comprising a sensor for detecting one or more conditions selected from the group of conditions consisting of a presence of a body in a room holding the light fixture, and motion of an object in the room holding the light fixture.

18. A light fixture, comprising:

an elongate light fixture housing having a longitudinal axis, a first end, and a second end opposite the first end;

one or more light sources housed in the light fixture housing;

a power connection for receiving electric power for the one or more light sources;

a light source driver circuit configured to receive power from the power connection and to drive the one or more light sources to produce light;

a first audio speaker module coupled to the first end of the light fixture housing through a first rotatable coupling, and a second audio speaker module coupled to the second end of the light fixture housing through a second rotatable coupling, wherein the first and second audio speaker modules are independently rotatable with respect to the light fixture housing via the first and second rotatable couplings to adjust the principal direction of sound emitted from the speaker module;

a wireless radio transceiver configured to receive transmissions of audio content to be played through the first and second audio speaker modules;

an audio driver circuit configured to receive power from the power connection and to drive first and second audio speaker modules to produce audio output of the audio content; and a microphone coupled to the audio driver circuit, wherein the light fixture is configurable to convert sound received via the microphone to electrical signals and to transmit the electrical signals via the wireless radio transceiver.

19. A method of operating a light fixture, the method comprising:

supplying electric power to a light fixture, the light fixture comprising:

an elongate light fixture housing having a longitudinal axis and two ends;

one or more light sources housed in the light fixture housing;

a power connection for receiving the electric power;

a light source driver circuit configured to drive the one or more light sources to produce light using the received electric power;

an audio speaker module coupled to one of the ends of the light fixture housing through a rotatable coupling, wherein the audio speaker module comprises a speaker housing;

a wireless radio transceiver configured to receive transmissions of audio content to be played through the audio speaker module; and an audio driver circuit configured to receive power from the power connection and to drive the audio speaker module to produce audio output of the audio content;

transmitting audio content to the light fixture via the wireless radio transceiver to be played though the speaker module via the audio driver circuit; and rotating the speaker module with respect to the light fixture housing via the rotatable coupling to adjust the principal direction of sound emitted from the speaker module.

* * * * *